US005649448A

United States Patent [19]

Koskimies et al.

[11] Patent Number: 5,649,448

[45] Date of Patent: Jul. 22, 1997

[54] SYSTEM FOR OVERALL CONTROL OF DIFFERENT TRANSVERSE PROFILES IN A PAPER WEB MANUFACTURED IN A BOARD OF PAPER MACHINE AND/OR TREATED IN A FINISHING MACHINE

[75] Inventors: Jouni Koskimies; Harri Mustonen; Jorma Virtanen, all of Jyväskylä ; Markku Ellila, Helsinki, all of Finland

[73] Assignee: Valmet Corporation, Helsinki, Finland

[21] Appl. No.: 441,414

[22] Filed: May 12, 1995

[30] Foreign Application Priority Data

May 16, 1994 [FI] Finland ..... 942270

[51] Int. Cl.[6] ..... G01L 5/04

[52] U.S. Cl. ..... 73/159; 73/862.451

[58] Field of Search ..... 73/159, 862.451, 73/862.453, 862.454, 862.471, 862.472; 242/534, 547, 49, 413, 413.1, 413.3, 413.4, 413.5, 413.6, 419; 28/185

[56] References Cited

U.S. PATENT DOCUMENTS 5,052,233 10/1991 Rantala ..... 73/862.45

FOREIGN PATENT DOCUMENTS 0408894 1/1991 European Pat. Off. .
80522 2/1990 Finland .
81848 8/1990 Finland .

OTHER PUBLICATIONS

Mustonen H., Ritala R.: "Coordination of Cross Direction Controls", Proceedings of Control Systems 1992 Conference, pp. 217–271, 1992.

Mustonen, H., Koskinen K., Ritala R., Valtonen E.: Poikkisuunnan laatuvaihteluiden kokonaishallinta, KCL:n seloste 2063, (Overall control of cross direction quality variations, KCL report 2063) 1993.

*Primary Examiner*—Richard Chilcot
*Assistant Examiner*—William L. Oen
*Attorney, Agent, or Firm*—Steinberg, Raskin & Davidson, P.C.

[57] ABSTRACT

A method for controlling transverse profiles of a web in a web-manufacturing machine, such as a board or paper machine, and/or being treated in a finishing machine. At least one of a transverse caliper, grammage and moisture profiles of the web is measured either directly or indirectly. Actuators acting upon these profiles are regulated by measurement signals. In order to optimize the quality of the web to be produced, the reel formation, and the runnability of the machine, the transverse tension profile of the web to be manufactured and/or treated is measured. Based on the measurement of the transverse tension profile, set profiles are formed which control the actuator(s) of the profile regulation.

18 Claims, 5 Drawing Sheets

SYSTEM FOR OVERALL CONTROL OF DIFFERENT TRANSVERSE PROFILES IN A PAPER WEB MANUFACTURED IN A BOARD OF PAPER MACHINE AND/OR TREATED IN A FINISHING MACHINE

BACKGROUND OF THE INVENTION

The present invention relates to a method and system for controlling transverse profiles of a web material in a machine which manufactures the same, such as a board or paper machine, and/or a finishing machine which treats the web material. In the invention, the transverse caliper and grammage profiles are measured and actuators acting upon the profiles are regulated by means of the measurements of these profiles. Also, the moisture profile of the web can be measured and an actuator such as a steam box regulated to affect the moisture profile based on a measured tension profile of the web.

In the prior art, the various property profiles of a web manufactured or treated by means of machines for handling a web material, in particular by means of paper machines and by means of on-line finishing devices connected to the paper machines or by means of separate off-line finishing devices, web profiles such as the grammage, fiber-orientation, moisture, and thickness profiles, are controlled by means of various modes of regulation. The overall aim of the regulation is a final web product having a quality as high as possible and good runnability of the machines.

Earlier, the significance of the transverse tension profile of a paper web both for the final product and for the runnability of the machines has been realized, but, with regard to their fields of application, the prior art methods for controlling the tension profile of the web have been small-scale partial solutions, in which the papermaking process and its optimization both in view of the final product produced and in view of the runnability of the machines have not been taken into account as a whole.

In prior art paper machines and finishing machines, attempts are made to produce a web whose moisture, grammage, caliper, and fiber-orientation profiles in the cross direction are as uniform as possible. The prior art manufacturing processes accomplish this objective typically so that the tension of the web to be produced in the cross direction of the web varies to a substantial extent, e.g., whereby the tension in a middle area of the web is about 300 N/m to about 400 N/m and in lateral areas of the web the tension is about 100 N/m, which results in the drawbacks which will be described in more detail later.

The starting point and a critical basis of the invention has been the realization of the significance of a uniform tension profile of the paper web, which significance has been divided into five factors in the following discussion:

1. runnability in the paper machine;
2. quality of the machine reel;
3. runnability and quality of the roll from the slitter-winder;
4. runnability in finishing; and
5. quality of the final product.

The factors listed above will be dealt with in more detail in the order listed above.

1. Since every portion of the web must always be in a tensioned state in the machine direction in a paper machine, when the web running takes place with a uniform tension, the average tension can be minimized and, thus, the preferred draw differences and web tension can be determined specifically for each paper grade. For example, when a maximal stretch at break is the desired goal, the web should be run preferably with a low tension level.

2. In view of the quality of the machine reel, the uniformity of the caliper profile, i.e., the thickness profile, of the web or a deviation from this profile in a specified manner is the most important factor. A second important factor is usually a uniform moisture profile of the web. A third factor in the order of importance is the tension profile. When the caliper profile and the moisture profile of the web are uniform, the moisture profile is generally passed on to the tension profile of the roll produced in the slitter-winder.

3. Unevenness and above all obliqueness in the tension profile of the slitter roll cause various disturbances of deformation depending on the paper grade produced. For example, in sack paper having a low modulus of elasticity and high stretching ability, an oblique tension profile results in convex/concave-headedness of the rolls, which has been established experimentally. Slack web portions have a detrimental effect on the runnability of the slitter, because slackness cannot be permitted at the blade.

4. In newspaper printing shops, it has been noticed that an uneven tension profile causes, among other things, wrinkles and faults in the alignment of colors. If the properties of a roll change to a great extent on exchange of a roll, a break in connection with the roll exchange is more probable. From experience, it is known that in sack factories, such a fault in tension profile when occurring is seen as unevenness of a solidified stretch (a paper that has been cut into sheets does not form a plane face in the non-tensioned state), which is particularly harmful when making the sack bottom.

5. Since the tension of the web during drying affects its strength properties, such as tensile stiffness, tensile energy absorption, elongation, and equivalent, an uneven tension profile results in non-homogeneous strength properties in the profile of the web in the cross direction.

The problems and the requirements of further development that have occurred in the prior art described above and in corresponding prior art have contributed to providing motivation for the present invention.

The control of various transverse profiles of a web is made particularly problematic by the fact that all profiles act upon other profiles. In respect of the complex nature of this matter, reference is made to the assignee's Finnish Patent No. 81,848, corresponding to English-language European Patent Publication No. 0 408 894, which describes the interdependence and control of the grammage and fiber-orientation profiles of paper.

OBJECTS AND SUMMARY OF THE INVENTION

Accordingly, it is an object of the present invention to provide a new and improved method for overall control of the tension profile of the paper web that is produced for the different stages of the papermaking and/or finishing process so that a substantially uniform transverse tension profile of the web can be obtained in view of achieving the objectives stated above.

It is another object of the present invention to provide a new and improved method for overall control of the tension profile of the paper web that is produced for the different stages of the papermaking and/or finishing process with a view toward optimizing the quality of the web to be produced, the reel formation, and the runnability of the machine.

In view of achieving the objects stated above and others, in the method in accordance with the invention, the transverse tension profile of the web to be manufactured and/or treated is measured and, based on the measurement of this transverse tension profile, set profiles are formed. By means of the set profiles, one or several actuators of the profile regulation are controlled.

In the invention, in the control of the tension profile of the web, such as a paper web, actuators provided for regulating the transverse profiles of the web in the paper machine are utilized. The control may be based either on direct response of the actuators to the tension profile and/or on an indirect effect by the intermediate of other profiles. In the control, it is possible to utilize the relationship of one or several actuators and/or of one or several transverse profiles of the web to the tension profile of the web.

In the control arrangement in accordance with the present invention for the tension profile of a web, such as a paper web, the interactions between the direct responses of different actuators and different profiles are preferably produced as a model based on response runs carried out by means of the paper machine and/or finishing machine and/or other, equivalent machines for the manufacture and/or treatment of the web material. Such machines constitute an object of application of the invention.

Between the transverse profiles controlled by the different actuators mentioned above and the tension profile of the web, the following trends are present: there is a positive trend with regard to the grammage profile and to the thickness profile, and there is a negative trend with respect to the moisture profile.

Since, in the application of the present invention, it is generally not favorable to use any existing profile-regulation actuator for the regulation of tension alone, in the control the effects of the operations of regulation required by the control of the tension profile on the other profiles are also taken into account.

With regard to the theory of regulation, the method in accordance with the invention for the control of the tension profile of a paper web is based on multiple-criteria optimization, by whose means compromises are sought between the variations of the different profile quantities. The general principles of control and related algorithms therefor are known from the prior art, e.g., from the following cited papers:

Mustonen, H., Koskinen K., Ritala R., Valtonen E.: Poikkisuunnan laatuvaihteluiden kokonaishallinta. KCL:n seloste 2063, (Overall control of cross direction quality variations, KCL report 2063) 1993; and Mustonen H., Ritala R.: "Coordination of Cross Direction Controls", Proceedings of Control Systems 1992 Conference, pages 217–271, 1992.

To summarize the above, the subject of the present invention is not simultaneous regulation of a number of profiles as a general method. Rather, the subject of the invention is the overall application of methods that are known in themselves in order to control the tension profile of a web and thus provide better web quality and good runnability of the machines.

In preliminary process tests that have been carried out, it has been realized that the tension profile of a web can be affected at least by means of the following actuators: spindles for regulation of the slice profile of the headbox, adjustable-crown rolls in the press, steam box and induction heaters in a calender and equivalent air-blow devices, and web moistening devices. When these actuators are employed, at the same time, consideration must be given to the effects of the controls to the moisture, grammage, thickness and fiber-orientation profiles of the paper web.

Even though, in a preferred embodiment of the invention, the tension profile of the web is measured at the vicinity of the reel-up, a uniform tension profile at this location is a reasonably reliable guarantee to the effect that the tension was already uniform in the area where the strength properties of the web were determined, i.e., at a dry solids content of the web equal to about 65% to about 85%.

Thus, in the method for controlling transverse profiles of a web in a web-manufacturing or finishing-treatment machine in accordance with the invention, a transverse caliper profile and/or a transverse grammage profile of the web is/are measured and signals generated representative of measurement values thereof. Actuators are regulated to affect each of the transverse caliper and grammage profiles of the web based on the signals representative of the respective measurement values thereof. The transverse tension profile of the web is measured from which it is possible to determine the transverse moisture profile of the web. The actuators can also be regulated to affect the transverse moisture profile of the web based on the measured transverse tension profile. The transverse tension profile of the web is measured, e.g., by a tension measurement device, and a set profile is derived for the measured profile based on measurement values of the tension profile of the web. The regulation of the actuators is controlled based on the set profile, e.g., to affect the tension of the web. When measuring all three profiles, a hierarchal regulation model can be applied in which an upper-level tension-profile control system derives a set profile for each profile and controls at least one of the actuators by means of the set profiles. In this embodiment, there is bi-directional communications over gaps in the hierarchal regulation model via buses such that the upper-level system receives the signals representative of measurement values of the transverse caliper profile, grammage profile and moisture profile.

It is an advantage of the invention that conventional and existing actuators of a paper machine can be utilized to affect the various profiles of the web, the actuators being, for example, headbox slice profiling means, a steam box situated in connection with a press roll, press-roll or calender-roll crown variation means, induction heaters or hot-air blower means of a calender, water or water-vapor supply means and air blower means.

In one embodiment, the transverse tension profile of the web is measured after a dryer section of the web-manufacturing machine substantially directly before a machine reel-up by means of a measurement station. A measurement signal is generated in the station and is directed therefrom to a tension-profile measurement unit. A regulation signal is derived from the tension-profile measurement unit and directed to a regulation unit for regulating a set of steam valves at a steam box situated in connection with a press roll in a press section preceding the dryer section. The regulation signal may also be directed from the tension-profile measurement unit, weighted and then directed to a regulating unit for regulating the steam box and to a regulation unit for regulating one of the actuators which affects a slice profile of a headbox.

In another embodiment, the transverse tension profile of the web is measured after a dryer section of the web-manufacturing machine by means of a measurement station situated prior to a coating station. A measurement signal is generated in the measurement station and is directed therefrom to a tension-profile measurement unit. A first regulation signal is derived in the tension-profile measurement unit and directed therefrom to a tension-profile regulation unit. A tension target profile is input into the tension-profile regulation unit so as to generate a second regulation signal therein. This second regulation signal is directed to a regulation unit for regulating a steam box of a press roll in a press section preceding the dryer section and/or to a zone regulation means which control crown adjustment of the press roll.

The invention also relates to a method in an on-line or off-line paper finishing machine for controlling transverse tension profile of a web being treated therein in order to optimize reel formation of a paper reel to be produced, quality properties of the product to be manufactured, and runnability of the finishing process. The machine includes a reel-up station in which the web is reeled. In the method, a thickness profile of the web is measured before the reel-up station, a reel build regulation unit and/or a coating-runnability regulation unit are controlled based on the measured thickness profile of the web, the transverse tension profile of the web is measured before the thickness profile measurement station and a web caliper profile regulation device is controlled based on the measured transverse tension profile. The web caliper profile regulation device may comprise an actuator, e.g., an induction heater or a hot-air blower device, that acts upon nip pressure in a calendaring nip through which the web passes. Furthermore, first regulation signals representative of the measured transverse tension profile of the web may be generated along with second regulation signals representative of the measured thickness profile of the web. These first and second regulation signals are directed to a weight selection unit and third regulation signals are generated therein. The reel build regulation unit and/or the coating-runnability regulation unit are controlled by third regulation signals received from the weight selection unit, and a regulation unit which regulates actuators for affecting the web thickness profile is controlled based on a signal received from the reel build regulation unit and/or the coating-runnability regulation unit.

In the following, the invention will be described in detail with reference to different exemplifying embodiments and typical environments of application of the invention illustrated in the schematic figures in the accompanying drawing. However, the invention is by no means strictly confined to the illustrated embodiments or environments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
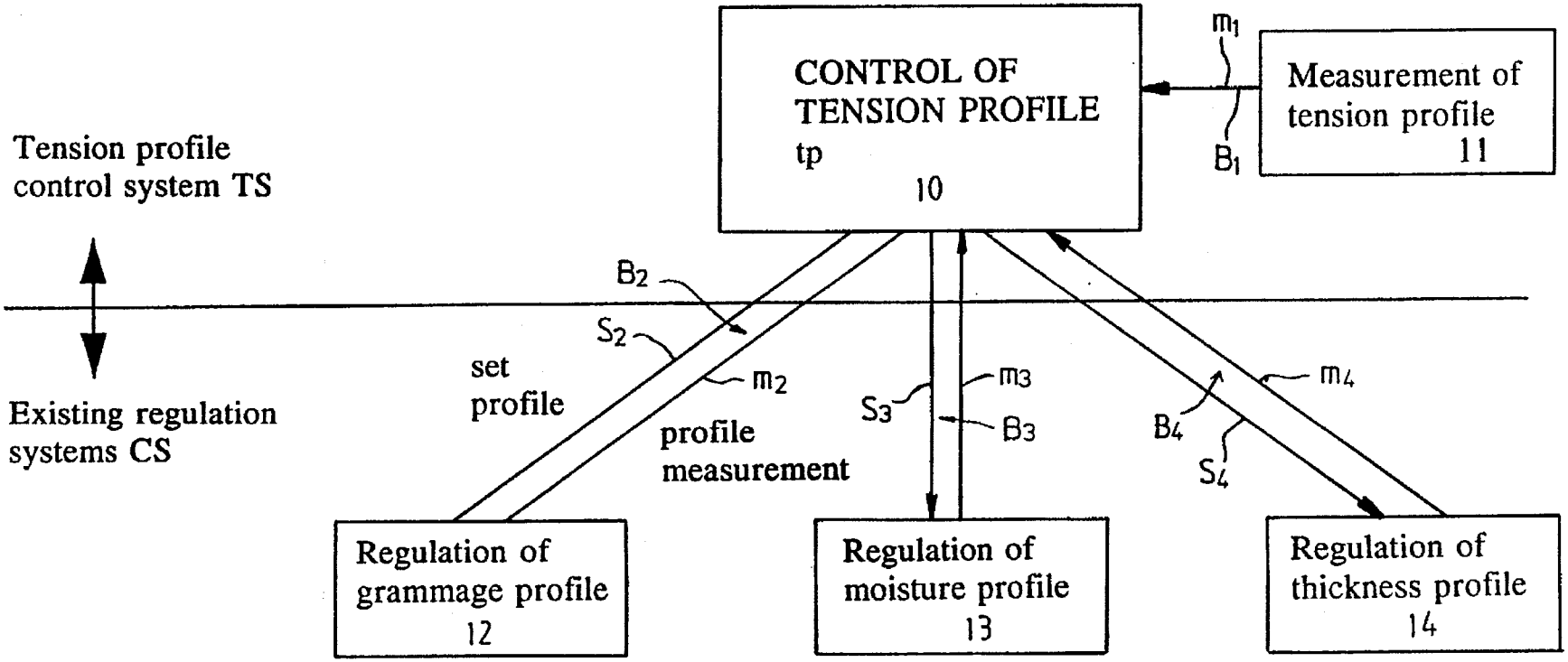
FIG. 1 illustrates the main principle of a control system of the tension profile of a paper web that is being manufactured by means of a paper machine and/or treated by a finishing machine and the connection of the control system with an existing regulation systems of the paper machine and the hierarchal relationship between these systems.

Referring to the accompanying drawings wherein the same reference numerals refer to the same or similar elements, FIG. 1 is a schematic illustration of the general principle of the control system of a transverse tension profile tp of a paper web that is being manufactured by means of a paper machine. In this control system, a hierarchal model of regulation is applied. In an upper level, a tension-profile control system TS controls other web-profile regulation stations 12,13 and 14 in a lower level CS by means of the transmission of set profiles s2,s3 and s4. The data communication between the upper level TS and the lower level CS takes place along buses $B_2$,$B_3$ and $B_4$ in two directions, i.e., the buses facilitate two-way or bi-directional communication. As such, the system TS of the upper level receives web profile measurement signals $m_2$,$m_3$ and $m_4$ from the other profile regulation systems in the lower level CS. A web tension measurement signal $m_1$ arrives in the system TS directly from tension measurement devices 11 associated with a tension profile control unit 10.

The lower-level CS regulation systems 12,13 and 14 in FIG. 1 operate in the same manner as in prior art regulation systems of a paper machine, i.e., each of them attempts to reach its own target profile. It is a difference in comparison to the prior art operation that the target profiles are not arbitrarily determined by each regulation system, but rather are determined by the upper-level system TS vis-a-vis the set profiles $s_2$,$s_3$ and $s_4$. In connection with the determination of set profiles $s_2$,$s_3$ and $s_4$, the upper-level system TS also takes into account the interdependence of the different profiles and above all the effects of the different profiles on the tension profile of the web.

If some of the actuators for the profile regulation in accordance with the invention are controlled without a particular profile regulation, these actuators can also be controlled directly from the upper-level TS system shown in FIG. 1. As an example of such controls, the control of a steam box when it is not used directly for regulating the moisture profile of the web on the basis of a moisture measurement should be mentioned. In such a case, of course, no moisture set profile is determined for the control system of the steam box, but the set values are determined directly for the zones in the steam box.

Figure 2:
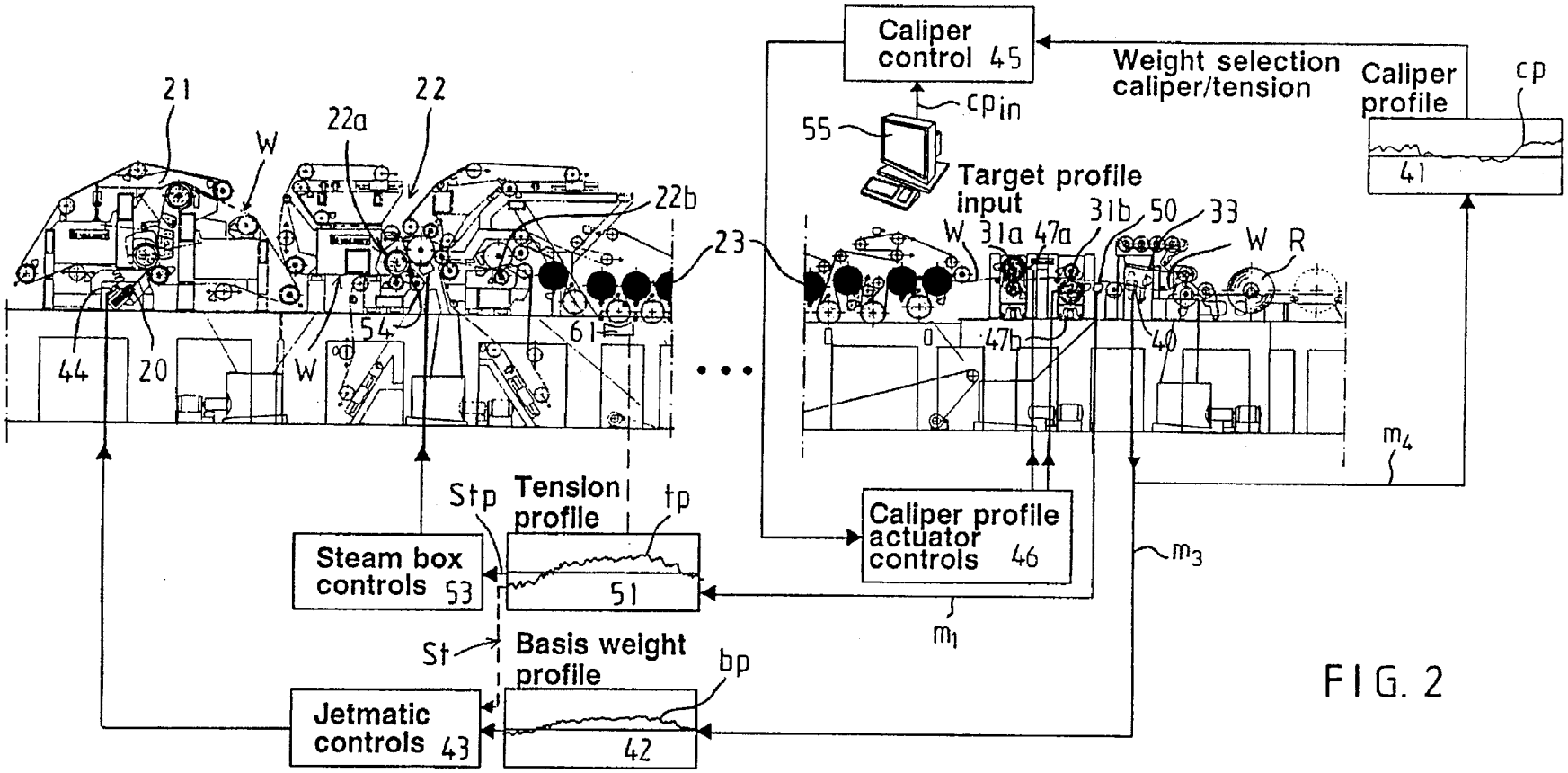
FIG. 2 illustrates a system in accordance with the invention for controlling the tension profile of a paper web as applied to a paper machine.

FIG. 2 shows a paper machine as an environment of application of the invention, with which paper machine a machine calender with its parts is integrated, together with a related system in accordance with the invention for controlling the transverse profiles of the paper web W to be produced. It should also be emphasized in this connection that the environment of application of the invention is not confined to the paper machine shown in FIG. 2 alone. Rather, the paper machine is shown just for the sake of example.

In the paper machine shown in FIG. 2, there is a former section 21 having a forming gap into which a headbox 20 feeds a pulp suspension jet. From the carrying wire of the former section 21, a web W is transferred onto a pick-up fabric on which it is carried into the press section 22. A steam box 54 is arranged on a suction sector of a suction roll 22*a* placed in connection with first and second nips in the press section. In the press section, there is a separate press nip 22*b*, after which the web W is transferred into a multi-cylinder dryer 23 of the paper machine. The dryer comprises a number of successive cylinder and wire groups. After the dryer section, the paper web W is passed to a machine calender which comprises two successive soft calenders 31*a* and 31*b* providing calendaring nips and in which, in connection with one of the calender rolls in each calendar, there are induction heaters 47*a* and 47*b* functioning as web W profiling devices. By means of heaters 47*a* and 47*b*, in a manner in itself known, the transverse profiles of the linear loads in the calendaring nips are controlled. After the calenders, the web W is transferred through a web tension measurement station 50 to a reel-up 33, for example a Pope-type reel-up, in which machine reels R are formed. The devices for measurement of the cross-direction tension profile of the paper web W are known in themselves from the prior art and therefore a description thereof is not necessary. However, for the sake of example only, regarding these prior art devices for measuring the profile of web tension, reference is made to the assignee's Finnish Patent No. 80,522.

As shown in FIG. 2, after the web W tension profile measurement station 50 and before the reel-up 33, there is a measurement station 40 for measuring the grammage profile or dry-weight profile of the web W and for measuring the caliper profile or thickness profile of the web W. From measurement station 40, the measurement signal $m_4$ of the thickness profile is passed to a unit 41 for caliper profile cp. Also, the measurement signal $m_3$ of the grammage profile is passed to a unit 42 for cross-direction profile bp of grammage. The unit 42 passes a set-value signal to a regulation unit 43 for regulating actuators 44 of the slice profile of the headbox 22. From the caliper profile unit 41, a profile signal is passed to a caliper regulation unit 45, to which the input signal $cp_{in}$ for the target profile of the web W is passed. The caliper regulation unit 45 controls a regulation unit 46 for the actuators of the caliper profile, which actuators control the induction heaters or equivalent hot-air blower devices placed in connection with the calender 31*a* and 31*b* rolls so that the calenders 31*a* and 31*b* accomplish the preset caliper profile of the web W.

In accordance with the embodiment shown in FIG. 2, the station 50 for measurement of the web W tension profile sends its measurement signal $m_1$ to a unit 51 for the tension profile tp. Unit 51 provides a set value $s_{tp}$ to a unit 53 for regulation of the set of feed valves of the steam box 54 in the press section 22. Instead of or in addition to the steam box 54 of the press section 22, it is possible to use an adjustable-crown press roll in the press section as an actuator controlled by the web W tension profile tp, by means of which roll the linear load in one or several press nips is affected. In addition to, or along with, the actuators stated above, it is possible to use the means 44 for regulation of the cross-direction profile of the slice of the headbox 20 as actuators, which means 44 of regulation are controlled by the tension-profile tp unit 51. This mode of regulation is illustrated by the interaction line $s_t$ drawn with as a dashed line in FIG. 2. It is the basic direction of the effect of the regulation of the steam box 54 that the more steam is fed therethrough, the dryer and more tensioned the web becomes at the location concerned, i.e., at which the steam is applied.

In FIG. 2, the caliper profile of the web W has an independent, closed, feed-back connected regulation circuit 40,$m_4$,41,45,46,47*a*,47*b* of its own. The grammage profile of the web W also has a closed feed-back connected regulation circuit $m_3$,42,43,44 of its own. As shown in FIG. 2, the circuit 51,53,54 for regulation of the transverse moisture profile of the web W obtains its set-value signal, i.e., its target profile, on the basis of the measurement signal $m_1$ of the web W tension profile measured directly before the reel-up 33. A combination of moisture measurement/tension measurement is also possible in this connection.

Figure 3:
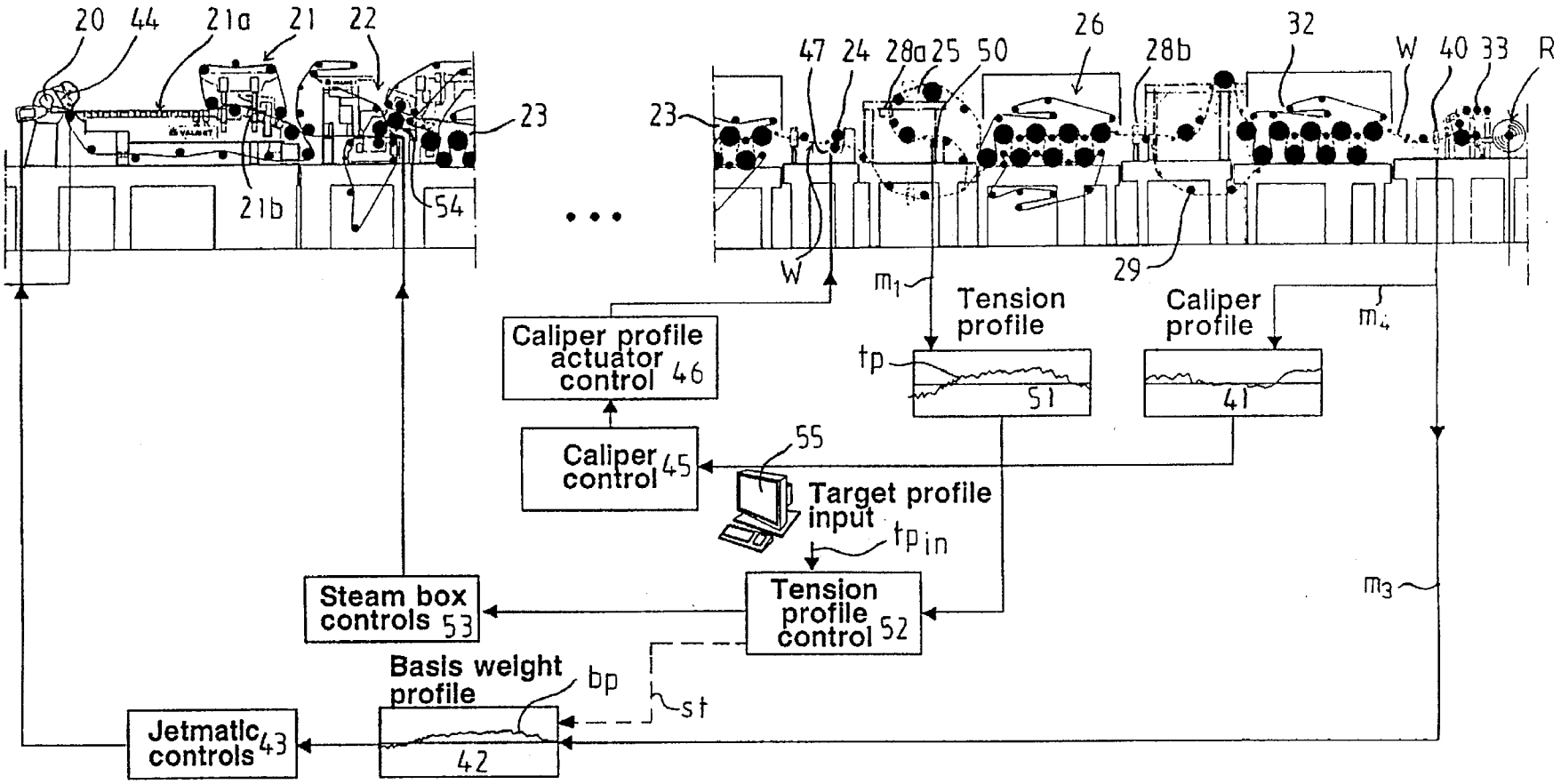
FIG. 3 illustrates a system in accordance with the invention for controlling the tension profile of a paper web as applied in a paper machine and in connection with an on-machine coating device situated in connection with the paper machine.

The paper machine that is shown schematically in FIG. 3 differs from that shown in FIG. 2 in the respect that the web former 21 as shown in FIG. 3 is a so-called hybrid former in which there is an initial single-wire portion 21*a* and after that, a twin-wire forming zone 21*b* which together constitute the forming section. The press section 22 and the dryer section 23 following after the forming zone are similar to those described above with reference to FIG. 2. After the dryer section 23, the web W is passed through an intermediate calender 24, in connection with which there are means for regulating the cross-direction caliper profile of the web W, such as induction heaters 47 or hot-air blower devices. After the intermediate calender 24, the web W is passed through an on-machine coating unit, such as a blade coater or a film-transfer coating station or device 28*a*, and through an airborne web dryer 25 to a cylinder group 26, which operates as an intermediate dryer and is provided with twin-wire draw. Before the coating station 28*a*, there is a station 50 for measuring the cross-direction tension profile tp of the web W. After the intermediate dryer 26, a second coating station or device 28*b* and an airborne web dryer 29 are arranged. Thereafter, the web W is passed to a second intermediate dryer 32 and from there further, through a web W grammage-profile measurement station 40 to the reel-up 33 in which the machine reels R are produced.

The system for controlling the cross-direction profiles of the web W shown in FIG. 3 includes a feed-back connected circuit 40,$m_4$,41,45,46,47 for regulating the web W caliper similar to that described above with reference to FIG. 2, in which circuit the effective actuator is the hot-air blower device 47 or the induction heater of the intermediate calender 24. Further, the control system of the cross-direction profiles of the web W as shown in FIG. 3 includes a feed-back connected loop 40,$m_3$,42,43,44 for regulating the cross-direction profile bp of grammage.

In FIG. 3, differing from FIG. 2, the station 50 for measurement of the cross-direction profile of the paper web W tension is not placed directly before the reel-up. Rather, it is placed before the first coating station 28*a*. By means of this arrangement, besides to produce a good machine reel R, attempts are also made to contribute to optimal runnability through the on-machine coating units 28*a* and 28*b* and through the related dryer units 25,26,29 and 32 as well as to provide a final web product of a high quality also in respect of the coating process.

In FIG. 3, the measurement signal $m_1$ of the cross-direction tension profile tp is directed from the measurement station 50 to the unit 51 and from unit 51 further to the tension profile regulation unit 52. The tension profile target profile $tp_{in}$ is also passed to the tension profile regulation unit 52 from a set-value unit 55. The target profile $tp_{in}$ need not be fully uniform, but it may be advantageous to make compromises in its respect, and also in respect of the caliper profile cp and the grammage profile bp, with a view toward achieving an optimal runnability and an optimal quality of the final web product as a whole. From the tension profile regulation unit 52, a regulation signal is passed to the regulation unit 53 of the steam box 54 which operates in the manner described above in relation to the embodiment shown in FIG. 2. Further, from the tension profile tp regulation unit 52, through the connection st represented by a dashed line, the grammage profile can be passed to the unit 42. Thus, the measured tension profile tp of the web W can be affected, besides by means of the steam box 54 of the press section 22 and/or by means of the crown adjustment of the press roll, also by means of the headbox slice profiling device 44. Moreover, the mutual weight proportions of these modes of regulation can be altered by means of a weighting unit 55,56 described below in relation to FIGS. 4 and 5.

Instead of or preferably in addition to the profile regulation actuators described above, if necessary, in the invention it is possible to apply various web W moistening devices which function to supply water or water vapor to the web. By means of these devices, the cross-direction moisture profile of the web W is partly controlled. Also, in the invention, as the web W profiling actuator, it is possible to use air-blow and pocket-ventilation devices in the dryer section of the paper machine. By means of such devices, the supply of drying air is regulated in the cross direction of the web W in order to control the moisture profile of the web in the cross direction. An example of such devices is a moisture profile regulation device 61, such as a water or water-vapor supply box and a system of valves, placed at the beginning of the dryer section 23 in FIG. 2 and controlled by the tension profile tp unit 51.

Figure 4:
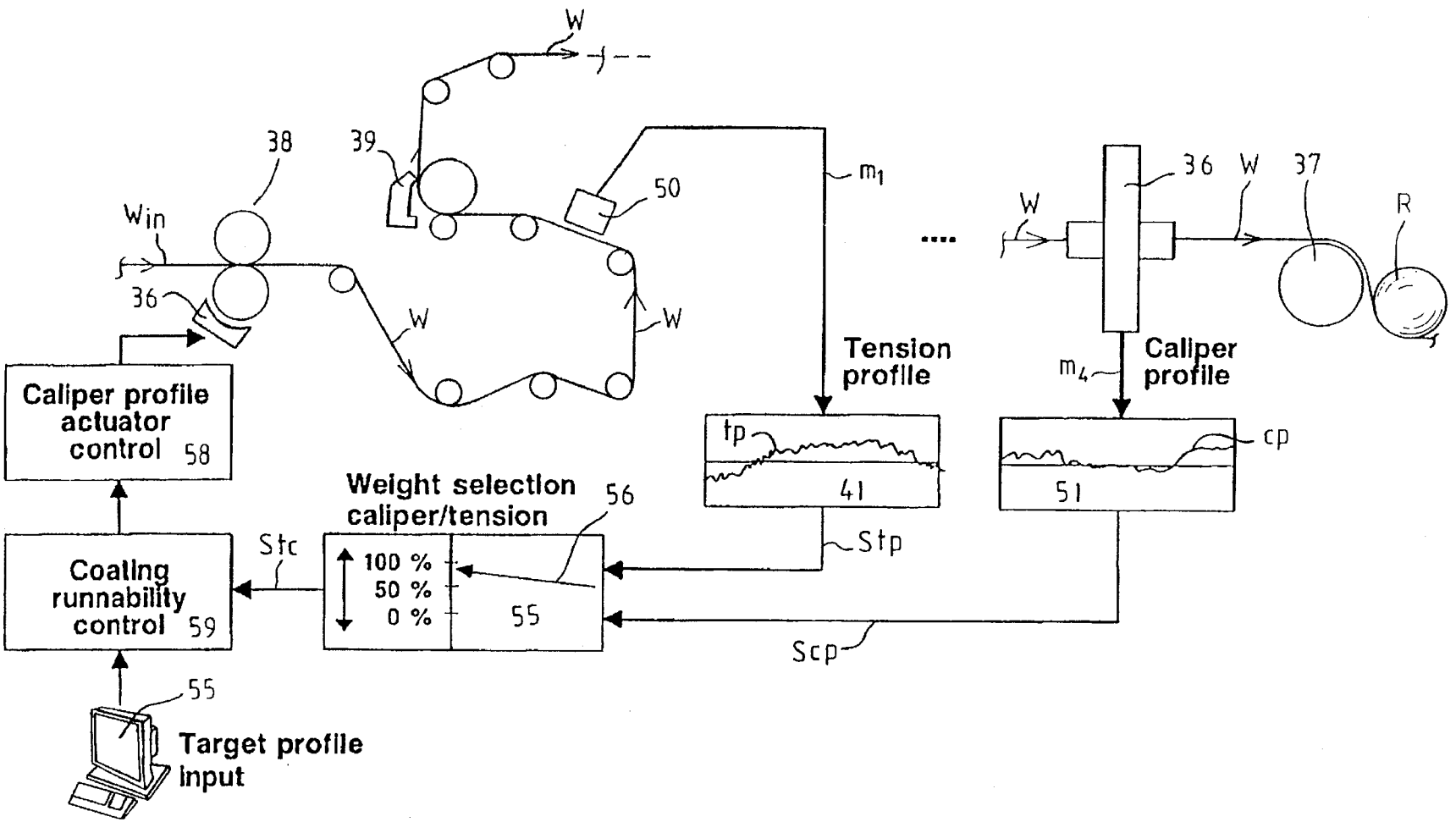
FIG. 4 illustrates the method in accordance with the invention as applied in connection with an off-machine coating device of a paper machine.
Figure 5:
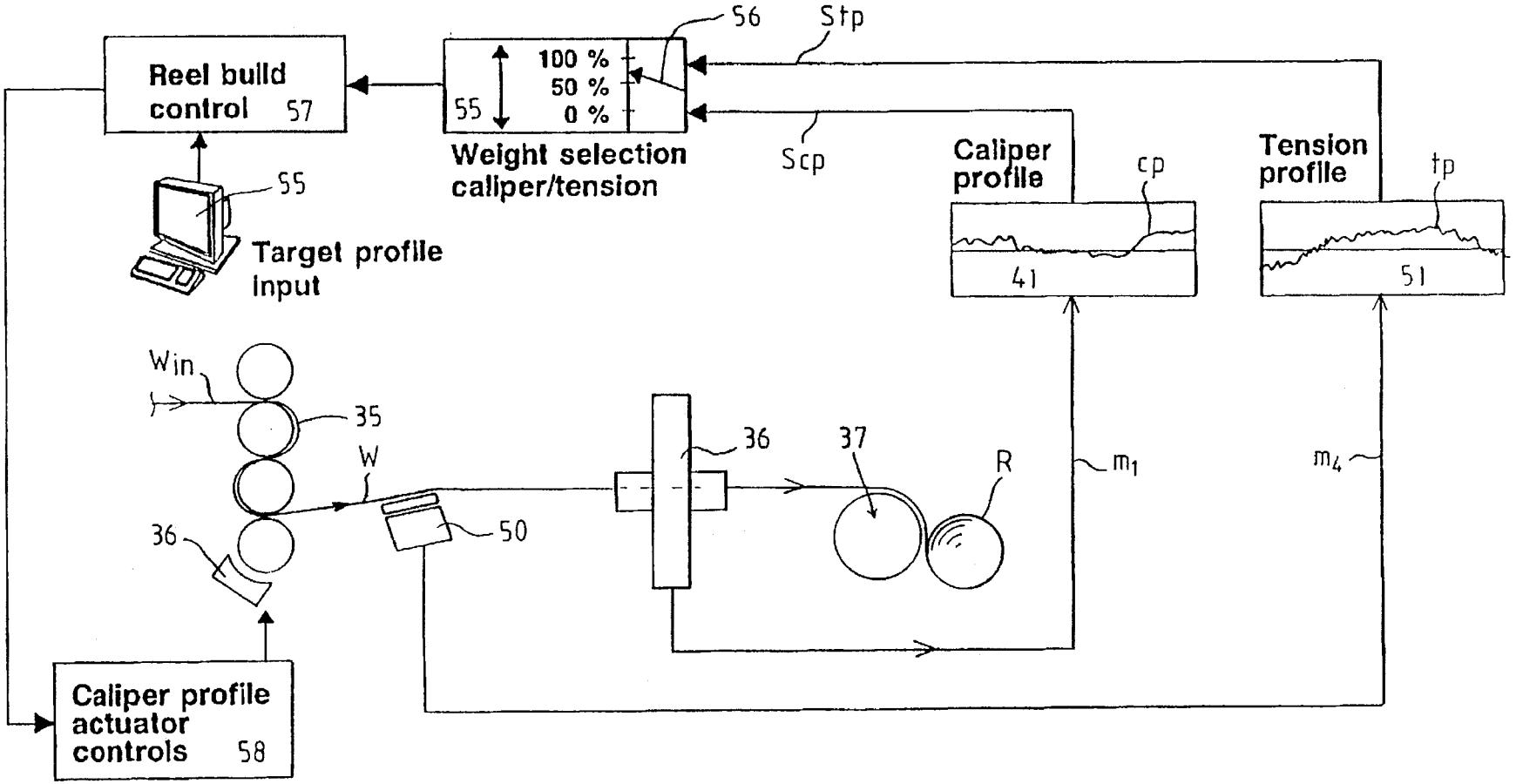
FIG. 5 illustrates the method in accordance with the invention as applied in connection with a machine calender or equivalent of a paper machine when the calender alone is used as an actuator.

FIGS. 4 and 5 illustrate the method in accordance with the invention for controlling the tension profile as applied in connection with the finishing treatment in relation to a paper machine, the finishing treatment may be performed by an on-machine or off-machine process, or a paper machine in which there are no other actuators except the thickness actuator of the calender.

In the embodiment shown in FIG. 4, the paper web Win is brought from the paper machine or paper reel to an intermediate calender 38. In connection with a calender roll of calender 38, there is a device for regulating the thickness profile, such as an induction heater 36 or a hot-air blower device. After the calender 38, the web W is passed through the tension profile tp measurement station 50 to the coating station 39. After this, there may be an airborne web dryer or equivalent and possibly a second coating station. Before a reel-up station 37, there is a station 36 for measuring the caliper of the coated web W, from which station 36 the measurement signal $m_4$ is passed to the caliper profiling unit 51 which provides a regulation signal $s_{cp}$ to the weight selection unit 55. To this unit 55, the regulation signal $s_{tp}$ is also directed from the web tension profile tp measurement unit 41. By means of the weight selection unit 55, the weight proportions of the regulation signals $s_{tp}$ and $s_{cp}$ can be regulated so that, if the weight value of one signal is X·100%, the weight value of the other signal is (1−x)·100%. The regulation signal $s_{tc}$ that was created in the unit 55 is passed to a coating-runnability regulation unit 59, to which the target profile is passed from the set-value unit 55. The unit 59 controls a caliper-profile actuator regulation unit 58 which provides the regulation signal to the actuator 36 of the calender 38. By means of the weight selection unit 55, a contribution can be made, with different paper grades, to an optimal quality and an optimal reel formation as well as to an optimal runnability of the web W through the coating process.

FIG. 5 is a general illustration of all processes in which there is a calender before the reel-up: on-line machine calender+reel-up, on-line soft calender+reel-up, off-line soft calender, supercalender. Such a combination is present in almost all paper machines, on-line coating machines, off-line coating machines and, of course, in off-line calenders.

FIG. 5 illustrates in particular an application of the invention to off-machine finishing in which the paper web $W_{in}$ is brought from a machine reel to a supercalender 35, in connection with which there is a web W caliper profile regulation device 36. From the calender 35, the web W is passed through the tension profile tp measurement station 50 and through the caliper profile measurement station 36 to the reel-up 37 where the reel R is formed. The caliper profile unit 41 and the tension profile unit 51 provide regulation signals $s_{tp}$ and $s_{cp}$ to the weight selection unit 55, which provides the regulation signal $s_{tc}$ to the reel build regulation unit 57. This unit receives the target profile from the set value unit 55. The unit 57 regulates the device 36 for the regulation of the control of the caliper profile at the supercalender 35 by means of the actuator regulation unit 58. By means of the weight selection unit 55, it is possible to optimize the reeling and the reel R quality as well as the runnability of the process.

In the control of the cross-direction tension profile of the web W, the interactions between the direct responses of the actuators to the regulation thereof and the different profiles are produced and formed into a model based on response runs carried out in a paper machine. From this model, the set profile can be derived. In the control of the cross-direction tension profile of the web W, multiple-criteria optimization is applied, by whose means a compromise is sought between the variations of different profile quantities while making use of regulation algorithms in themselves known.

The model is located in the tension profile control system TS. In multiple-criteria optimization, the penalty function $J_{tot}=\Sigma_1\lambda_i J_i$ is minimized, wherein $\lambda_i$ is the weight factor of the profile i, and $\Sigma_i\lambda_i=1$. (Steuer, R. E.: Multiple Criteria Optimization: Theory and Applications, John Wiley & Sons Inc., 1986). $J_i$ is the variance i of the penalty function, typically the difference between the measured profile and the set profile, related to the regulation of the profile i, $J_i=(X_{i\ measurement}-X_{i\ set})^2$.

The interactions between the profiles and the responses of the regulation actuators are illustrated by means of models, by means of which it is possible to calculate the change produced by a change of the setting of a certain actuator or by a change of a certain profile in a certain profile, for example the model $A_{ij}$ between the actuator $u_i$ and the profile $x_j$:

$$A_{ij}=\frac{\delta x_j}{\delta u_j}$$

in which case the response of a regulation change $\Delta u_i$ on the profile $x_j$ can be calculated: $\Delta x_j=A_{ij}\Delta u_i$. In the simplest case, $A_{ij}$ is a linear operator (coefficient or response matrix).

The examples provided above are not meant to be exclusive. Many other variations of the present invention would be obvious to those skilled in the art, and are contemplated to be within the scope of the appended claims.

We claim:

1. A method for controlling transverse profiles of a web in a web-manufacturing or finishing-treatment machine, comprising the steps of:

measuring a transverse caliper profile and a transverse grammage profile of the web and generating signals representative of measurement values thereof, regulating actuators to affect each of the transverse caliper and grammage profiles of the web based on the signals representative of the respective measurement values thereof, measuring a transverse tension profile of the web, a transverse moisture profile of the web being determinable from the measured tension profile, regulating said actuators to affect the transverse moisture profile of the web based on the measured transverse tension profile, deriving a set profile for at least one of the transverse caliper, grammage and moisture profiles of the web based on measurement values of the tension profile of the web, and controlling the regulation of at least one of said actuators based on the set profile.

2. The method of claim 1, further comprising the steps of:

measuring the transverse moisture profile of the web and generating signals representative of measurement values thereof, and regulating at least one of said actuators to affect the transverse moisture profile of the web based on the signals representative of the measurement values of the transverse moisture profile.

3. The method of claim 1, further comprising the steps of:

measuring the transverse caliper, grammage and moisture profiles of the web and generating signals representative of measurement values thereof, applying a hierarchal regulation model in which an upper-level tension-profile control system derives a set profile for each of the transverse caliper, grammage and moisture profiles of the web and controls a respective one of said actuators by means of the set profiles, communicating bi-directionally over gaps in the hierarchal regulation model via buses such that the upper-level system receives the signals representative of measurement values of the transverse caliper, grammage and moisture profiles, and wherein the transverse tension profile of the web is measured by a tension measurement device.

4. The method of claim 1, wherein the regulation of a respective one of said actuators is controlled to affect the tension of the web, further comprising the step of:

utilizing existing actuators of a paper machine to affect the transverse caliper, grammage and moisture profiles of the web, said actuators being selected from the group consisting of headbox slice profiling means, a steam box situated in connection with a press roll, press-roll or calender-roll crown variation means, induction heaters or hot-air blower means of a calender, water or water-vapor supply means and air blower means.

5. The method of claim 1, wherein the regulation of a respective one of said actuators is controlled to affect the tension of the web, further comprising the step of:

performing response runs in a paper machine to determine interactions between the regulation of said actuators and form a model based thereon from which the set profile is derived.

6. The method of claim 1, wherein the regulation of a respective one of said actuators is controlled to affect the tension of the web, further comprising the step of:

applying multiple-criteria optimizing in which a compromise is sought between variations of different profile quantities by utilizing regulation algorithms.

7. The method of claim 1, wherein the transverse tension profile of the web is measured after a dryer section of the web-manufacturing machine substantially directly before a machine reel-up by means of a measurement station, further comprising the steps of:

generating a measurement signal in said station, directing said measurement signal from said station to a tension-profile measurement unit in which a regulation signal is derived therefrom, and directing said regulation signal from said tension-profile measurement unit to a regulation unit for regulating a set of steam valves at a steam box situated in connection with a press roll, in a press section preceding the dryer section.

8. The method of claim 7, further comprising the steps of:

directing said regulation signal from said tension-profile measurement unit, weighting said regulation signal, and directing said weighted regulation signal to a regulating unit for regulating the steam box and to a regulation unit for regulating one of said actuators which affects a slice profile of a headbox.

9. The method of claim 1, wherein the transverse tension profile of the web is measured after a dryer section of the web-manufacturing machine by means of a measurement station situated prior to a coating station, further comprising the steps of:

generating a measurement signal in said station, directing said measurement signal from said station to a tension-profile measurement unit in which a first regulation signal is derived therefrom, and directing said regulation signal from said tension-profile measurement unit to a tension-profile regulation unit, inputting a tension target profile into said tension-profile regulation unit, generating a second regulation signal in said tension-profile regulation unit, directing said second regulation signal to a regulation unit for regulating a steam box of a press roll in a press section preceding the dryer section and/or to a zone regulation means which control crown adjustment of the press roll.

10. The method of claim 1, wherein the transverse caliper, grammage and moisture profiles of the web are measured, one of said actuators being regulated to affect each of the transverse caliper, grammage and moisture profiles, a set profile being derived for each of the transverse caliper, grammage and moisture profiles, and the regulation of a respective one of said actuators being controlled based on the set profile.

11. A method in an on-line or off-line paper finishing machine for controlling transverse tension profile of a web being treated therein in order to optimize reel formation of a paper reel to be produced, quality properties of the product to be manufactured, and runnability of the finishing process, said machine including a reel-up station in which the web is reeled, comprising the steps of measuring a transverse thickness profile of the web before the reel-up station, controlling at least one of a reel build regulation unit and a coating-runnability regulation unit based on the measured transverse thickness profile of the web, measuring a transverse tension profile of the web before the thickness profile measurement station, and controlling a web caliper profile regulation device based on the measured transverse tension profile.

12. The method of claim 11, wherein said web caliper profile regulation device comprising an actuator that acts upon nip pressure in a calendaring nip through which the web passes.

13. The method of claim 12, wherein said actuator is an induction heater or a hot-air blower device.

14. The method of claim 11, further comprising the steps of:

generating first regulation signals representative of the measured transverse tension profile of the web, generating second regulation signals representative of the measured transverse thickness profile of the web, directing said first and second regulation signals to a weight selection unit and generating third regulation signals therein, controlling at least one of said reel build regulation unit and said coating-runnability regulation unit by means of said third regulation signals received from said weight selection unit, and controlling a regulation unit which regulates actuators for affecting the web thickness profile based on a signal received from said at least one of said reel build regulation unit and said coating-runnability regulation unit.

15. A system for controlling transverse profiles of a web in a web-manufacturing or finishing-treatment machine, comprising measurement means for measuring a transverse caliper profile and a grammage profile of the web and for generating signals representative of measurement values thereof, actuators situated in connection with the machine to affect a respective one of the transverse caliper and grammage profiles of the web based on the signals representative of the respective measurement values thereof, at least one additional actuator situated in connection with the machine to affect a transverse moisture profile of the web, tension profile measurement means for measuring a transverse tension profile of the web, and a processor coupled to said tension profile measurement means for receiving on measurement values of the transverse tension profile of the web and deriving therefrom a set profile for at least one of the transverse caliper, grammage and moisture profiles of the web, said processor controlling the regulation of at least one of said actuators and said at least one additional actuator based on the derived set profile.

16. The system of claim 15, wherein said measurement means measure the transverse caliper, grammage and moisture profiles of the web, said actuators being selected from the group consisting of headbox slice profiling means, a steam box situated in connection with a press roll, press-roll or calender-roll crown variation means, induction heaters or hot-air blower means of a calender, water or water-vapor supply means and air blower means.

17. The system of claim 15, wherein said measurement means measure the transverse moisture profile of the web, said actuators being selected from the group consisting of headbox slice profiling means, a steam box situated in connection with a press roll, press-roll and calender-roll crown variation means, water and water-vapor supply means and air blower means.

18. The system of claim 15, wherein said measurement means measure the transverse thickness profile of the web, said actuators affecting the thickness profile being selected from the group consisting of induction heaters and hot-air blower means of a calender.

* * * * *